US007009466B1

(12) United States Patent
Fiedziuszko et al.

(10) Patent No.: US 7,009,466 B1
(45) Date of Patent: Mar. 7, 2006

(54) FAULT-TOLERANT POWER COMBINING SYSTEM

(75) Inventors: Slawomir J. Fiedziuszko, Palo Alto, CA (US); Marc R. Bjorkman, Yardley, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 11/014,819

(22) Filed: Dec. 20, 2004

(51) Int. Cl.
*H01P 5/12* (2006.01)

(52) U.S. Cl. ..... 333/100; 333/105; 333/125; 333/127

(58) Field of Classification Search ..... 333/100, 333/105, 125, 127; 330/51
See application file for complete search history.

(56) References Cited

U.S. PATENT DOCUMENTS 3,845,392 A * 10/1974 Covill ..... 455/129
4,315,222 A * 2/1982 Saleh ..... 333/124 D
4,965,530 A 10/1990 Katz
5,083,094 A * 1/1992 Forsberg ..... 330/124 R
5,767,755 A 6/1998 Kim et al.
6,323,742 B1 * 11/2001 Ke ..... 333/127
6,812,806 B1 11/2004 Leikus et al.
6,844,793 B1 * 1/2005 Kenington ..... 333/101

* cited by examiner

*Primary Examiner*—Robert Pascal
*Assistant Examiner*—Kimberly Glenn
(74) *Attorney, Agent, or Firm*—McDermott Will & Emery LLP

(57) ABSTRACT

A power combining system includes multiple amplifiers, a reactive combiner for combining the output power of the amplifiers and a short plate. Switches are used to electrically connect an output of each of the amplifiers to an input of the reactive combiner. In the event of amplifier failure, the switches are used to electrically connect the short plate to an input of the reactive combiner in place of the failed amplifier.

14 Claims, 6 Drawing Sheets

FAULT-TOLERANT POWER COMBINING SYSTEM

STATEMENT AS TO RIGHTS TO INVENTIONS MADE UNDER FEDERALLY SPONSORED RESEARCH OR DEVELOPMENT

Not applicable to this invention.

FIELD OF THE INVENTION

The present invention concerns a power combining system and in particular concerns a fault-tolerant power combining system.

BACKGROUND OF THE INVENTION

Power combining networks are used to combine the power generated by a group of amplifiers into a single output. Power combining networks provide solutions for many applications that require more output power than can be provided using a single conventional amplifier. For example, power combining networks are commonly used to broadcast signals in satellite communication systems such as Satellite Digital Audio Radio Service (SDARS) systems and Direct Broadcast Satellite (DBS) systems.

FIG. 1 is a schematic diagram depicting the primary components of a conventional eight-input power combining network 10. As shown in FIG. 1, power combining network 10 includes eight amplifiers 11, which are each fed a common signal in parallel. Each of amplifiers 11 is isolated from the rest of network 10 by an isolator 12. Isolator 12 intercepts power reflected back towards amplifier 11 from network 10 and redirects that power into load 13. The output of each amplifier 11 is coupled to a first stage of power combiners 14 via a redundancy switch 15. Using three stages of power combiners 14, the output power from each of the eight amplifiers 11 is combined into a single output signal.

A significant advantage of a power combining network is the ability of the network to compensate for amplifier failure. Typical power combining network designs, especially those used in satellite communication systems, include redundant amplifiers. For example, an eight-amplifier system such as that shown in FIG. 1 will usually have ten to twelve amplifiers. To simplify the drawing, redundant amplifiers are not depicted in FIG. 1. If one of amplifiers 11 fails, redundancy switches 15 are used to disconnect the output of the failed amplifier 11 from the first stage of power combiners 14 and connect one of the redundant amplifiers in its place. In this manner, power combining network 10 maintains a desired output power in the event of amplifier failure.

A problem arises when the number of amplifier failures exceeds the number of redundant amplifiers in the system. In an ideal system, the power loss (in dB) of an N-input system in this situation is $$10 \cdot \log_{10}\left(\frac{N-m}{N}\right) \tag{1}$$

where N is the number of amplifier inputs in the system and m is the number of failed amplifiers (with m<=N−1). However, the power loss suffered by a conventional system is significantly greater than that of an ideal system. This difference is better understood by examining the operating characteristics of network 10 depicted in FIG. 1.

Power combiner 14 is typically implemented using a four-port waveguide power combiner to handle the power necessary for most satellite applications. Signals fed into the two input ports of power combiner 14 constructively combine into a single signal. If the two signals are appropriately phased with respect to each other, a single signal with twice the power is output from one of the output ports. If the two signals are not phased correctly with respect to each other, a portion of the output power is diverted to load 16 attached to the other output port. When an amplifier fails, and therefore does not provide a signal to one of the input ports, an ideal system would pass the power of the signal of the operational amplifier connected to the power combiner through to the next stage of power combiners. However, in a conventional system a significant portion of that power is diverted into load 16. Accordingly, the power loss (in dB) from one or more failed amplifiers in a conventional N-input system is $$10 \cdot \log_{10}\left(\left(\frac{N-m}{N}\right)\right)^2 \tag{2}$$

where N is the number of amplifier inputs in the system and m is the number of failed amplifiers (with m<=N−1).

FIG. 2 is a graph showing the power loss (in dB) due to failed amplifiers in a sixteen-input power combining network. The dotted line in the graph shows the power loss suffered by an ideal system as the number of failed amplifiers increases. The dashed line shows the power loss suffered by a conventional system as the number of failed amplifiers increases. As shown in the graph, the power loss suffered by a conventional system is greater than that suffered by an ideal system and the difference increases with the number of failed amplifiers.

Accordingly, a need exists for a new power combining network design. The new power combining network should improve network efficiency and recover more power in the event of amplifier failure. Furthermore, the new power combining network should be cost effective and minimize any additional hardware required.

SUMMARY OF THE INVENTION

The present invention addresses the foregoing deficiencies of conventional power combining networks by providing a fault-tolerant power combining system. Using short plates and reactive combiners, the invention recovers a significant portion of the power lost in conventional systems upon failure of one or more amplifiers. In particular, short plates are used to redirect power reflected out of the reactive combiners back into the reactive combiner to be combined with the signal input into the reactive combiner by a functioning amplifier. In this manner, a significant portion of power lost using conventional power combining networks is recovered using a minimal amount of additional hardware.

According to one aspect of the invention, a power combining system includes multiple amplifiers, a reactive combiner for combining the output power of the amplifiers and a short plate. Switches are used to electrically connect an output of each of the amplifiers to an input of the reactive combiner. In addition, switches are used to electrically connect the short plate to an input of the reactive combiner in place of a failed amplifier.

According to another aspect of the invention, a power combining system includes multiple amplifiers, multiple power combiners for combining the output power from the amplifiers, and short plates. The power combiners are arranged in stages, with the power combiners used in the first stage being reactive combiners. Switches are used to electrically connect the output of each of the amplifiers to a respective input of a reactive combiner in the first stage of power combiners. Switches are also used to electrically connect a short plate to an input of a reactive combiner in place of a failed amplifier.

Preferably, the multiple amplifiers amplify a common signal in parallel. It is also preferable that the electrical path length between the short plate and the reactive combiner allow a signal reflected by the short plate back into the reactive combiner to be in phase with respect to a second signal input into the reactive combiner. Finally, isolators preferably isolate the amplifiers and redirect power reflected by the reactive combiner into a load connected to the respective isolator.

The foregoing summary of the invention has been provided so that the nature of the invention can be understood quickly. A more detailed and complete understanding of the preferred embodiments of the invention can be obtained by reference to the following detailed description of the invention together with the associated drawings.

DETAILED DESCRIPTION OF THE INVENTION

Figure 1:
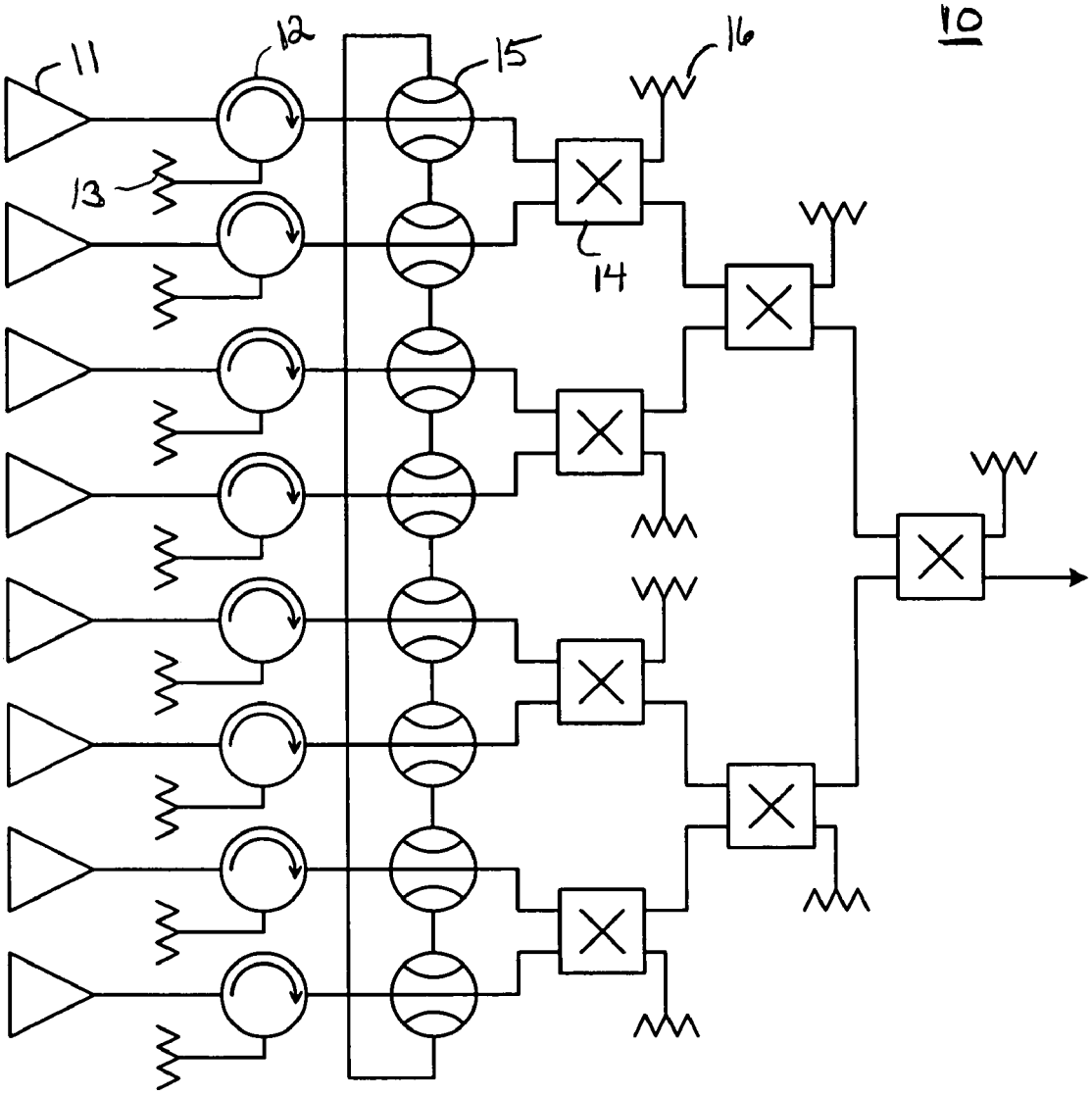
FIGURE 1 (PRIOR ART)
FIG. 1 is a schematic diagram depicting a conventional power combining network.
Figure 3:
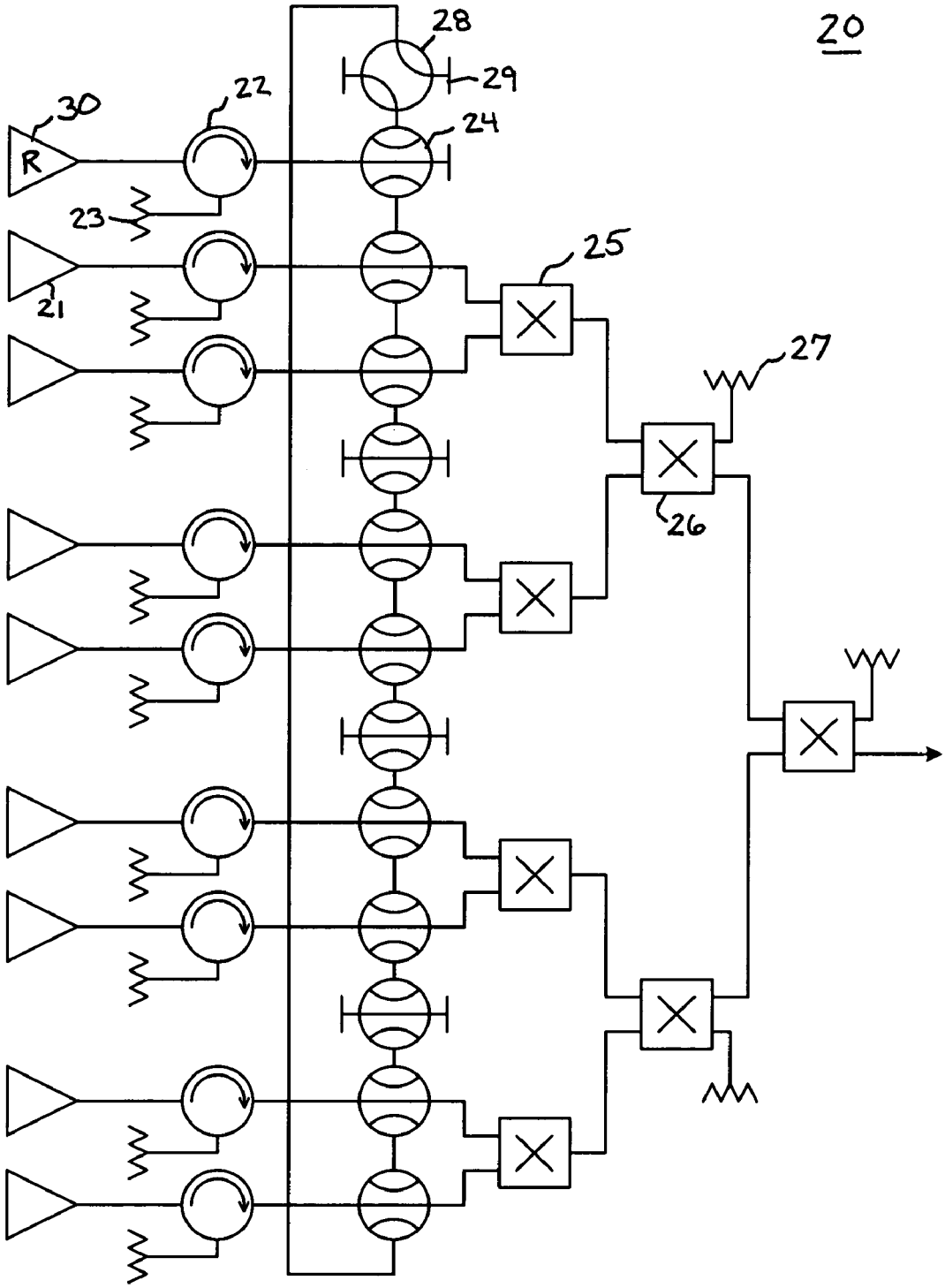
FIG. 3 is a schematic diagram depicting a power combining network according to the present invention.

FIG. 3 is a schematic diagram depicting the primary components of an eight-input power combining network 20 designed according to the present invention. Similar to the conventional power combining network 10 depicted in FIG. 1, network 20 includes eight amplifiers 21, which are each fed a common signal in parallel. According to one embodiment of the invention, amplifiers 21 are implemented using tube amplifiers. But one skilled in the art will recognize that other types of amplifiers can be used in the invention without departing from the scope thereof. Each of amplifiers 21 is isolated from the rest of network 20 by an isolator 22. Isolator 22 intercepts power reflected back towards amplifier 21 from the rest of network 20 and redirects the power into load 23.

The output of each amplifier 21 is coupled to a first stage of power combiners via a redundancy switch 24. Unlike conventional systems, the first stage of power combiners is made up of reactive combiners 25. In this embodiment of the invention, the latter two stages of power combiners are made up of four-port power combiners 26, with their respective loads 27, as in conventional systems. However, alternative embodiments of the invention include implementations using reactive combiners 25 in one or more of the latter stages of power combiners.

Network 20 also includes one or more redundant amplifiers, which are represented by redundant amplifier 30 depicted in FIG. 3, to replace failed amplifiers. Redundancy switches 24 are used to disconnect a failed amplifier 21 from the first stage of reactive combiners 25 and connect one of the redundant amplifiers in its place. Finally, network 20 includes short plate switches 28, which are used to connect a short plate 29 to an input port of a reactive combiner 25 in place of a failed amplifier 21 when no redundant amplifiers are available. A more detailed description of the operation of short plate switch 28, short plate 29 and reactive combiner 25 is provided below.

Isolators 22, redundancy switches 24, reactive combiners 25, four-port combiners 26 and short plate switches 28 are implemented using waveguides according to one embodiment of the invention. The materials and size of the waveguides used are dependent upon the frequency bandwidth of the signal being amplified and combined by network 20. The design of appropriate waveguides to be used in the individual components is well known to those of ordinary skill in the art and will not be described herein.

The operation of the present invention will now be described with reference to FIGS. 4, 5 and 6. Power combining network 20*a* depicted in these figures is a two-input power combining network which combines the output power of amplifiers 21*a* and 21*b*. The signal power output by amplifier 21*a* and/or 21*b* is shown as a bold line with arrows indicating the direction of the signal. For purposes of this description it is assumed that the power output by each of amplifier 21*a* and 21*b* is equal when the amplifiers are operating correctly.

Figure 4:
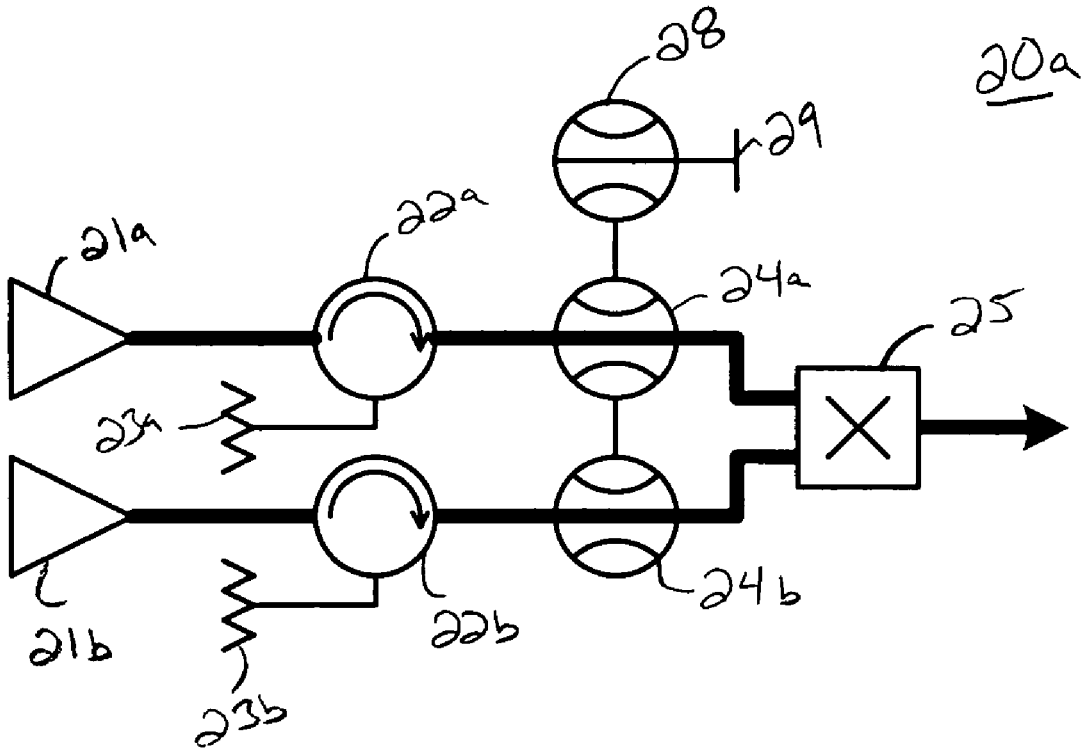
FIG. 4 is a schematic diagram depicting a two-input power combing network with both amplifiers functioning.

FIG. 4 depicts the operation of network 20*a* when both amplifiers 21*a* and 21*b* are operational. In this situation, the signal power output by amplifier 21*a* is fed into a first input port of reactive combiner 25 via isolator 22*a* and redundancy switch 24*a*. The signal power output by amplifier 21*b* is fed into a second input port of reactive combiner 25 via isolator 22*b* and redundancy switch 24*b*. When the signals output by amplifiers 21*a* and 21*b* are properly phased with respect to each other, a single signal having twice the power provided by each of amplifiers 21*a* and 21*b* is output by reactive combiner 25.

Figure 5:
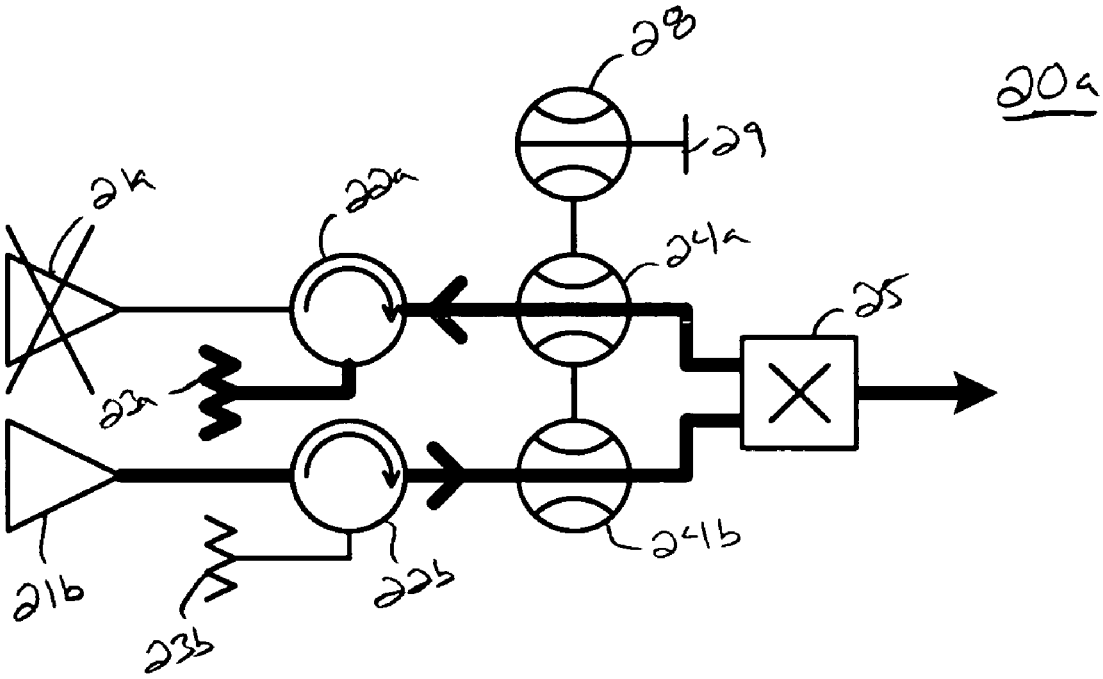
FIG. 5 is a schematic diagram depicting a two-input power combining network with one failed amplifier prior to operation of the invention.

FIG. 5 depicts the operation of network 20*a* upon failure of amplifier 21*a* without the operation of the invention. When the two signals input into reactive combiner 25 are not properly phased with respect to each other, a portion of the signal power is reflected out the input ports. When one of the two input signals ceases, half of the signal power from the remaining operational amplifier is reflected out the input port connected to the failed amplifier while the other half of the signal power is output by reactive combiner 25. The reflected signal power passes back through redundancy switch 24*a* and is directed into load 23*a* by isolator 22*a*. Accordingly, upon failure of amplifier 21*a*, the signal power output by reactive combiner 25 is one-quarter of the signal output power when both amplifier 21 a and amplifier 21*b* are operational.

Figure 6:
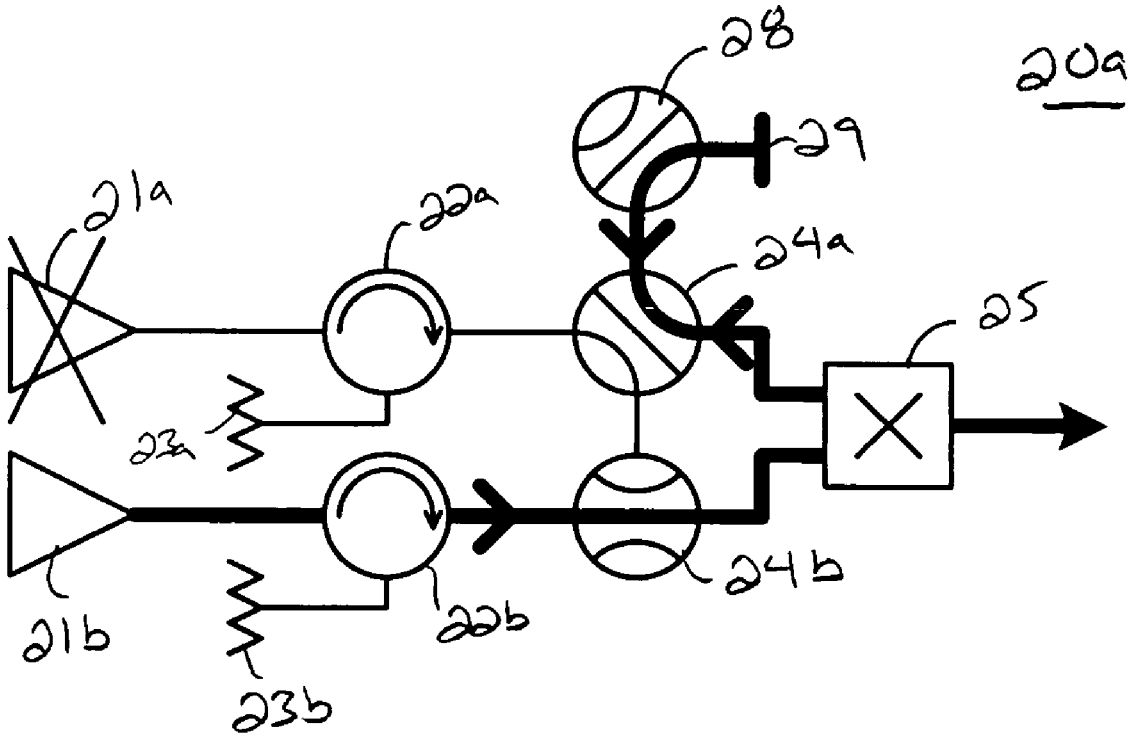
FIG. 6 is a schematic diagram depicting a two-input power combining network with one failed amplifier after operation of the invention.

FIG. 6 depicts the operation of network 20*a* according to the present invention upon failure of amplifier 21*a*. As described above, half of the signal power output by amplifier 21*b* is reflected out the input port of reactive combiner 25 connected to failed amplifier 21*a*. The present invention reflects this signal power back into the input port of reactive combiner 25 by redirecting the reflected signal power to short plate 29 via redundancy switch 24*a* and short plate switch 28. Short plate 29 reflects the signal power back to the input port of reactive combiner 25 via short plate switch 28 and redundancy switch 24*a*.

To maximize recovery of lost power, the electrical path length between short plate 29 and reactive combiner 25 is designed so that the reflected signal power reaches reactive combiner 25 properly phased with respect to the signal power output by operational amplifier 21*b*. This electrical path length is determined based on factors such as the frequency bandwidth of the signals being output and the design of reactive combiner 25, which are well known to those skilled in the art. In a perfectly efficient system, the signal power output by reactive combiner 25 will equal that of operational amplifier 21*b*.

The foregoing description of the invention described a two-input power combining network 20*a*. The eight-input power combining network 20 depicted in FIG. 3 operates in a similar manner with each pair of amplifiers 21, together with their respective isolators 22, redundancy switches 24, reactive combiner 25, short plate switches 28 and short plates 29, operating in the manner described above with respect to FIGS. 4, 5 and 6. It is to be understood, however, that the invention is not limited to networks having the two or eight inputs. For example, other embodiments having a similar overall design might include four, sixteen, or thirty-two input systems. Additionally, one skilled in the art will recognize that the concepts of the present invention can be applied in other power combining systems have different numbers of inputs.

Figure 2:
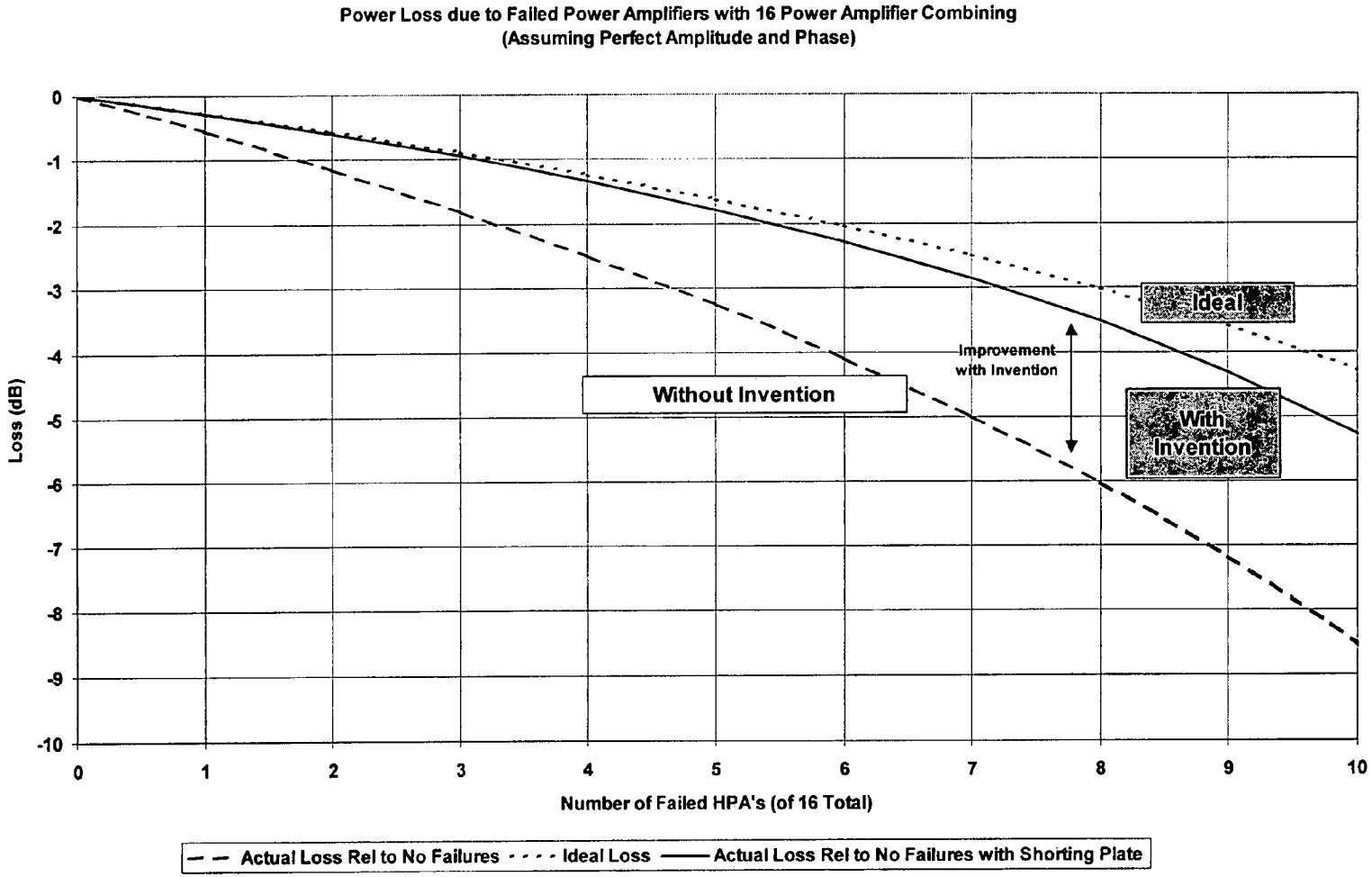
FIG. 2 is a graph depicting power loss due to failed amplifiers in a sixteen-input power combining network.

As described above, the present invention provides a fault-tolerant power combining system which recovers and outputs more signal power in the event of amplifier failure than conventional power combining systems. According to the invention, the power loss (in dB) in an N-input power combing network is $$10 \cdot \log_{10}\left(4 \cdot \left(\frac{N-m}{2 \cdot N-m}\right)^2\right) \quad (3)$$

where N is the number of amplifier inputs to the system and m is the number of failed amplifiers (with m<=N−1). Returning to FIG. 2, the power loss for a system according to the present invention is shown as a solid line. As can be seen in FIG. 2, the present invention reduces the amount of power loss over that of a conventional system and approaches the power loss expected from an ideal system.

The foregoing detailed description of the invention is intended to illustrate preferred embodiments of the invention. However, the examples set forth above are not intended to limit the scope of the invention, which should be interpreted using the claims provided below. It is to be understood that various modifications can be made to the illustrated examples of the invention without departing from the spirit and scope of the invention.

What is claimed is:

1. A power combining system, comprising:

a plurality of amplifiers;

a reactive combiner for combining the output power of said plurality of amplifiers;

a short plate; and a plurality of switches for electrically connecting an output of each of said plurality of amplifiers to a respective input of said reactive combiner and for electrically connecting said short plate to an input of said reactive combiner in place of a failed one of said plurality of amplifiers, wherein the electrical path length between said short plate and said reactive combiner allows a signal reflected by said short plate back to said reactive combiner to be in phase with respect to a second signal input into said reactive combiner.

2. The power combining system according to claim 1, wherein said plurality of amplifiers amplify a common signal in parallel.

3. The power combining system according to claim 1, further comprising a plurality of isolators, wherein each of said plurality of isolators isolates a respective one of said plurality of amplifiers from signals reflected by said reactive combiner.

4. The power combining system according to claim 3, further comprising a plurality of loads electrically connected to said plurality of isolators, respectively, wherein said plurality of isolators redirect signals reflected by said reactive combiner into said plurality of loads.

5. The power combining system according to claim 1, further comprising a redundant amplifier, wherein said plurality of switches electrically connect an output of said redundant amplifier to an input of said reactive combiner in place of a failed one of said plurality of amplifiers.

6. A power combining system, comprising:

a plurality of amplifiers;

a plurality of power combiners arranged in a plurality of electrically connected stages for combining the output power of said plurality of amplifiers, wherein the plurality of power combiners arranged in a first stage comprise a plurality of reactive combiners;

a plurality of short plates; and a plurality of switches for electrically connecting an output of each of said plurality of amplifiers to a respective input of the plurality of said reactive combiners arranged in the first stage and for electrically connecting one of said plurality of short plates to an input of said plurality of power combiners in place of each failed amplifier of said plurality of amplifiers, wherein the electrical path length between one of said plurality of short plates and an electrically connected one of said plurality of reactive combiners allows a signal reflected by said short plate back to said electrically connected reactive combiner to be in phase with respect to a second signal input into said electrically connected reactive combiner.

7. The power combining system according to claim 6, wherein said plurality of amplifiers amplify a common signal in parallel.

8. The power combining system according to claim 6, wherein a second stage of said plurality of power combiners combines the output power of said plurality of reactive combiners arranged in the first stage.

9. The power combining system according to claim 8, wherein the second stage of said plurality of power combiners comprises a four-port power combiner.

10. The power combining system according to claim 8, wherein a third stage of said plurality of power combiners combines the output power of said plurality of power combiners arranged in the second stage.

11. The power combining system according to claim 10, wherein the third stage of said plurality of power combiners comprises a four-port power combiner.

12. The power combining system according to claim 6, further comprising a plurality of isolators, wherein each of said plurality of isolators isolates a respective one of said plurality of amplifiers from signals reflected by said plurality of reactive combiners arranged in the first stage.

13. The power combining system according to claim 12, further comprising a plurality of loads electrically connected to said plurality of isolators, respectively, wherein said plurality of isolators redirect signals reflected by said plurality of reactive combiners into said plurality of loads.

14. The power combining system according to claim 6, further comprising a plurality of redundant amplifiers, wherein said plurality of switches electrically connect an output of one of said redundant amplifiers to an input of said reactive combiner in place of a failed one of said plurality of amplifiers.

* * * * *

UNITED STATES PATENT AND TRADEMARK OFFICE

CERTIFICATE OF CORRECTION

PATENT NO. : 7,009,466 B1
APPLICATION NO. : 11/014819
DATED : March 7, 2006
INVENTOR(S) : Slawomir J. Fiedziuszko et al.

It is certified that error appears in the above-identified patent and that said Letters Patent is hereby corrected as shown below:

IN THE SPECIFICATION:

Column 2, line 24, Equation (2), "$10 \cdot \log_{10} \left(\left(\frac{N-m}{N}\right)\right)^2$" should read --$10 \cdot \log_{10} \left(\left(\frac{N-m}{N}\right)^2\right)$--.

Signed and Sealed this

Twenty-eighth Day of November, 2006

JON W. DUDAS
*Director of the United States Patent and Trademark Office*